US007833938B2

(12) United States Patent
Yunoki et al.

(10) Patent No.: US 7,833,938 B2
(45) **Date of Patent: *Nov. 16, 2010**

(54) THERMAL TRANSFER SHEET

(75) Inventors: Shinichi Yunoki, Tokyo (JP); Daisuke Fukui, Tokyo (JP); Makoto Hashiba, Tokyo (JP)

(73) Assignee: Dai Nippon Printing Co., Ltd., Tokyo (JP)

( * ) Notice: Subject to any disclaimer, the term of this patent is extended or adjusted under 35 U.S.C. 154(b) by 178 days.

This patent is subject to a terminal disclaimer.

(21) Appl. No.: 11/663,332

(22) PCT Filed: Sep. 28, 2005

(86) PCT No.: PCT/JP2005/017879

§ 371 (c)(1),
(2), (4) Date: Mar. 21, 2007

(87) PCT Pub. No.: WO2006/035833

PCT Pub. Date: Apr. 6, 2006

(65) Prior Publication Data

US 2007/0269620 A1 Nov. 22, 2007

(30) Foreign Application Priority Data

Sep. 30, 2004 (JP) ..... 2004-286803
Mar. 30, 2005 (JP) ..... 2005-098998

(51) Int. Cl.
*B41M 5/41* (2006.01)

(52) U.S. Cl. ..... 503/227; 428/32.64

(58) Field of Classification Search ..... None
See application file for complete search history.

(56) References Cited

U.S. PATENT DOCUMENTS

2001/0034302 A1 10/2001 Suzuki et al.

FOREIGN PATENT DOCUMENTS

EP 1 136 279 A1 9/2001

(Continued)

OTHER PUBLICATIONS

Official Action issued in JP2005-282627.

*Primary Examiner*—Bruce H Hess
(74) *Attorney, Agent, or Firm*—Birch, Stewart, Kolasch & Birch, LLP

(57) ABSTRACT

To provide a thermal-transfer sheet having a back layer that can be prepared without heat treatment such as aging and is superior in heat resistance and sliding property, and has no such defect of printed images as wrinkling and tailing during printing.

A thermal-transfer sheet having a substrate film, a transfer ink layer formed on one face thereof, and a back layer formed on the other face thereof, the back layer comprising:

a binder containing a polyamide-imide resin (A) having a Tg of 200° C. or higher and a polyamide-imide silicone resin (B) having a Tg of 200° C. or higher, as determined by differential thermal analysis, a mixture of a polyvalent metal salt (C) of alkylphosphoric ester and a metal salt (D) of alkylcarboxylic acid, a silicone oil (E), and an inorganic filler (F) containing fine particles (F1) of an inorganic material having a Mohs' hardness of 3 or less alone or a mixture of fine particles (F1) of an inorganic material and fine particles (F2) of an inorganic material having a Mohs' hardness of more than 3, the metal salts (C) and (D) having an average particle size of 5 μm to 20 μm and the inorganic filler (F) having an average particle size of 0.05 to 5.5 μm.

7 Claims, 3 Drawing Sheets

FOREIGN PATENT DOCUMENTS

| | | | |
|---|---|---|---|
| JP | 61-184717 | A | 8/1986 |
| JP | 62-220385 | A | 9/1987 |
| JP | 05-229271 | A | 9/1993 |
| JP | 05-229272 | A | 9/1993 |
| JP | 08-113647 | A | 5/1996 |
| JP | 08-244369 | A | 9/1996 |
| JP | 10-297124 | A | 11/1998 |
| JP | 2001-205947 | A | 7/2001 |
| JP | 2001-334760 | A | 12/2001 |
| JP | 2003-25741 | A | 1/2003 |
| JP | 2003-89274 | A | 3/2003 |

THERMAL TRANSFER SHEET

This application is the U.S. national stage application of International Application No. PCT/JP2005/017879, filed Sep. 28, 2005. This application also claims priority under 35 USC §119(a)-(d) of Application Nos. JP 2005-098998 filed Mar. 30, 2005 and JP 2004-286803, filed Sep. 30, 2004.

TECHNICAL FIELD

The present invention relates to a thermal-transfer sheet for use in thermal transfer printer using a heating means such as thermal head.

BACKGROUND ART

When used as a substrate for thermal-transfer sheet, plastic films, which are weaker to heat, often cause problems of deterioration in releasing and sliding property and breakage of the substrate film because of deposition (sticking) of the film, crust, on the thermal head during printing. For that reason, a method of forming a heat-resistant layer, for example, of a thermosetting resin higher in heat resistance was proposed, but, although the heat resistance is improved, the sliding property of the thermal head is not improved, and a two-liquid-type coating solution should be prepared, because a hardening agent such as crosslinker should be used. In addition, long-term heat treatment (aging) over a period of dozens of hours at relatively low temperature is needed after coating, for preparing a sufficiently hardened film, because the substrate is a plastic thin film that prohibits high temperature treatment. Such a heat treatment makes the production process more complicated and causes problems such as wrinkling during heat treatment and blocking due to adhesion of the coated face to another face in contact, without strict temperature control.

Addition of a silicone oil, low-melting point wax, surfactant, or the like was proposed for improvement in sliding property, but use of an unsuitable lubricant causes problems such as transfer of the thermal-transfer sheet onto the opposite face when the sheet is wound, deposition of buildup on the thermal head during printing, and thus, deterioration in density and definition of the printed image. Although a method of adding a filler for removing the deposit is known, use of an unsuitable filler causes problems such as wrinkling during printing because of increase in the friction coefficient of thermal head and abrasion wear of the thermal head.

To solve these problems above, Patent Documents 1 and 2 disclose a back layer of a silicone-modified polyurethane resin; Patent Document 3, a heat-resistant protective layer of a polysiloxane-polyamine-based block copolymer; and Patent Document 4, a heat-resistant protective layer containing a silicone-modified polyimide resin, but each of the layers had a problem of sticking during high-energy printing because the resin is less heat resistant or a problem in the safety in working environment, demanding an additional exhaust system because of use of a special solvent. Alternatively, Patent Documents 5 and 6 propose a heat-resistant protective layer of a polyamide-imide resin composition, and Patent Document 7 proposes a heat-resistant protective layer containing a polyamide-imide resin and a lubricant, but these layers were insufficient in heat resistance and caused a problem of adverse influence on the printed image by deposition of buildup on the head during high-energy printing.

As shown in FIG. 1, the thermal head commonly used in thermal transfer printer is a thin film-typed head having a heat-releasing substrate 1, and a heat-resistant layer 5, a heat-generating resistor 2, an electrode 3, and an abrasion-resistant layer 4 formed thereon. The heat-releasing substrate 1 is, for example, made of a ceramic material, and the heat-resistant layer 5, which is, for example, made of glass, is formed, as raised on the heat-releasing substrate 1. The thickness of the top area thereof is 20 to 150 μm, and the heat conductivity thereof is approximately 0.1 to 2 Watt/m·deg. The heat-generating resistor 2, which is, for example, made of $Ta_2N$, W, Cr, Ni—Cr, or $SnO_2$, is formed linearly by a thin film-forming method such as vacuum deposition, CVD, or sputtering, and the thickness thereof is approximately 0.05 to 3 μm. The electrode 3, which is, for example, made of Al, is formed on the area of the heat-resistant layer 5 other than the top area, for electrical supply to the heat-generating resistor 2, and the thickness thereof is approximately 0.1 to 34 μm. The abrasion-resistant layer 4 is, for example, made of $Ta_2O_3$, SiN, or SiC.

Various full-color image patterns are formed and used as thermal transferred images under the condition of the thermal head. Among many conditions, under the condition where a dark painted image and a half tone image are printed close to each other, there was observed a problem of staining by tailing, seemingly due to the influence of the buildup temporarily deposited in the area where the thermal head and the back face of the thermal-transfer sheet become in contact with each other, occurring on the area of half tone image, when the heat energy applied to the thermal head varies rapidly from high to low energy.

In the thermal transfer-recording method, it is possible to print images different in size if the size of the image is smaller than the width in the main scanning direction of thermal head, by using a thermal-transfer sheet and an image-receiving paper similar in width. When an image having a width of (W1) is printed on multiple image-receiving papers with a thermal-transfer sheet and then an image having a broader width of (W2) on the image-receiving paper with the thermal-transfer sheet, a problem of image lack separated by a width of (W1) occurs (see FIG. 2). As shown in FIG. 3, the problems occurs, because edge buildup 33 depositing on the thermal head 30 at the both terminals as separated by a distance of the image-receiving paper width of (W1) during printing at an image-recording width of (W1) prevents heat transfer in the terminal crust areas during printing at a broader paper width of (W2).

Generally in forming a print having no white edge extending in the main scanning direction of thermal head 30 by the thermal transfer-recording method, an image is printed in larger size than the image-receiving paper 32 by using a thermal-transfer sheet 31 having a width wider than the image-receiving paper 32. The thermal-transfer sheet 31 in the area beyond the width of the image-receiving paper 32 is exposed to the heat from the heating unit 34 of the thermal head, but the heat of the thermal head is not used for printing. As a result, the heat-resistant protective layer fused by the heat applied to the heat-resistant protective layer of the thermal-transfer sheet 31 adheres as buildup on the position of the thermal head 30 corresponding to the terminals of the image-receiving paper.

Patent Document 1: Japanese Patent Application Laid-Open No. 61-184717

Patent Document 2: Japanese Patent Application Laid-Open No. 62-220385,

Patent Document 3: Japanese Patent Application Laid-Open No. 5-229271

Patent Document 4: Japanese Patent Application Laid-Open No. 5-229272

Patent Document 5: Japanese Patent Application Laid-Open No. 8-113647

Patent Document 6: Japanese Patent Application Laid-Open No. 8-244369

Patent Document 7: Japanese Patent Application Laid-Open No. 10-297124

DISCLOSURE OF THE INVENTION

Problems to be Solved by the Invention

An object of the present invention, which was made under the circumstance above, is to provide a thermal-transfer sheet having a back layer that can be prepared by using a single-liquid coating solution not containing a special solvent harmful during production or in working environment but containing a common solvent, can be prepared without heat treatment such as aging and is superior in heat resistance and sliding property, and prevent defects of the printed image such as wrinkling during printing, image-stain by tailing, in particular, image lack caused by edge buildup.

Means to Solve the Problems

Accordingly, the present invention relates to a thermal-transfer sheet having a substrate film, a transfer ink layer formed on one face thereof, and a back layer formed on the other face thereof, the back layer comprising:

a binder containing a polyamide-imide resin (A) having a Tg of 200° C. or higher and a polyamide-imide silicone resin (B) having a Tg of 200° C. or higher, as determined by differential thermal analysis, a mixture of a polyvalent metal salt (C) of alkylphosphoric ester and a metal salt (D) of alkylcarboxylic acid, a silicone oil (E), and an inorganic filler (F) containing fine particles (F1) of an inorganic material having a Mohs' hardness of 3 or less alone or a mixture of fine particles (F1) of an inorganic material and fine particles (F2) of an inorganic material having a Mohs' hardness of more than 3, the metal salts (C) and (D) having an average particle size of 5 μm to 20 μm and the inorganic filler (F) having an average particle size of 0.05 to 5.5 μm.

Effect of the Invention

The thermal-transfer sheet according to the present invention can be prepared without heat treatment such as aging, is superior in heat resistance and sliding property, and does not generates defects of printed image, for example, by wrinkling and tailing during printing.

EXPLANATION OF REFERENCES

Figure 1:
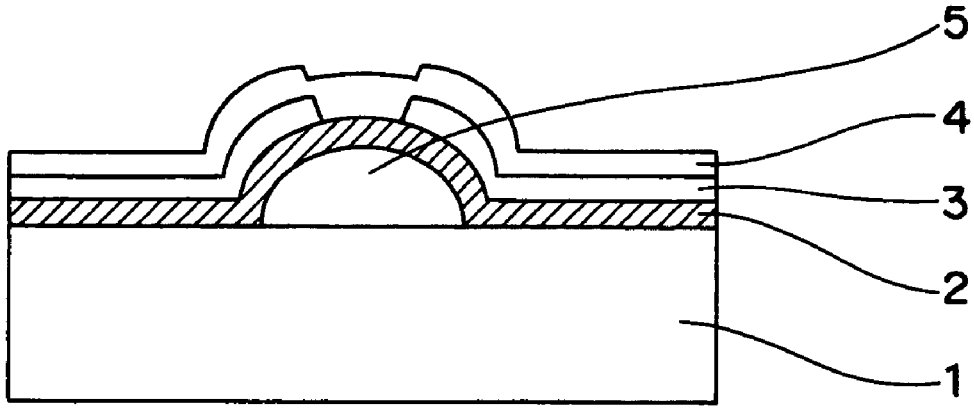
FIG. 1 is a schematic view illustrating the configuration of a thermal head used in thermal transfer recording.
Figure 2:
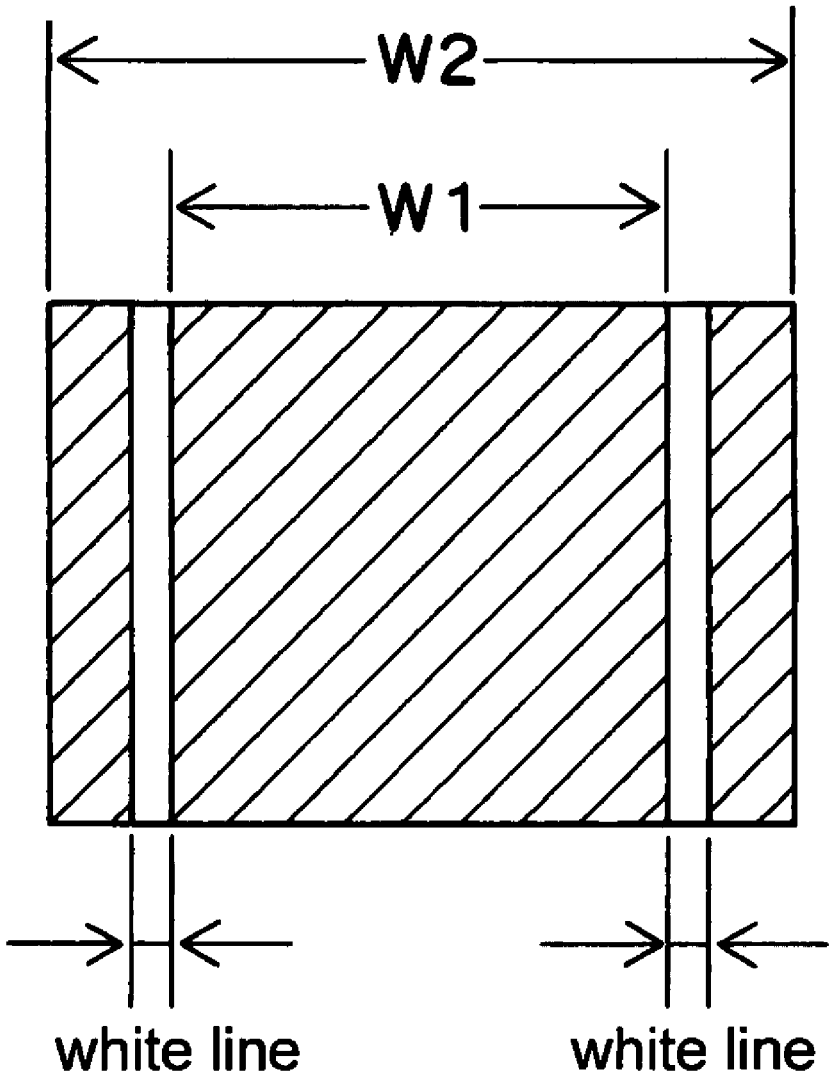
FIG. 2 is a view for explanation of white line formed during printing.
Figure 3:
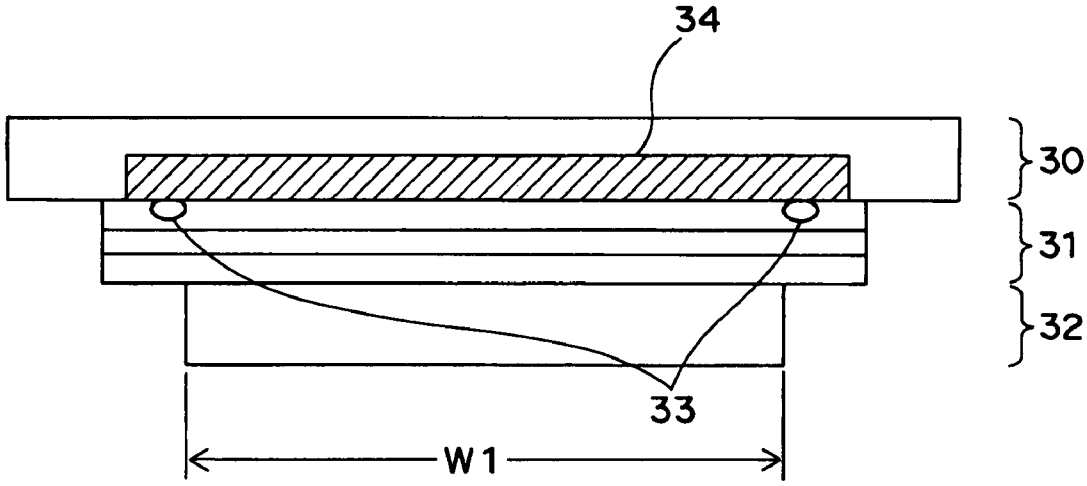
FIG. 3 is a view for explanation of the cause for white line.

1: Heat-releasing substrate
2: Heat-generating resistor
3: Electrode
4: Abrasion-resistant layer
5: Heat-resistant layer
30: Thermal head
31: Thermal transfer sheet
32: Image-receiving paper
33: Edge buildup

BEST MODE FOR CARRYING OUT THE INVENTION

The thermal-transfer sheet according to the present invention basically has a substrate film, a transfer ink layer formed on one face thereof, and a back layer formed on the other face thereof.

(Substrate Film)

Any one of known materials having a heat resistance and a strength to some extent may be used as the substrate film constituting the thermal-transfer sheet according to the present invention. Examples thereof include films such as of polyethylene terephthalate film, 1,4-polycyclohexylene dimethylene terephthalate film, polyethylene naphthalate film, polyphenylene sulfide film, polystyrene film, polypropylene film, polysulfone film, aramide film, polycarbonate film, polyvinyl alcohol film, cellulose derivatives such as cellophane and cellulose acetate, polyethylene film, polyvinyl chloride film, nylon film, polyimide film, and ionomer film; and papers and nonwoven fabrics such as capacitor paper, paraffin paper, and paper; and a nonwoven fabric, composites of a nonwoven fabric or paper and a nonwoven fabric and a resin, having a thickness of approximately 0.5 to 50 μm, preferably of 3 to 10 μm.

(Back Layer)

The binder constituting the back layer is a mixture of a polyamide-imide resin (A) and a polyamide-imide silicone resin (B). They are used as mixed at the ratio A:B of 1~5:5~1, preferably 1~2:2~1 (by mass). Use of a polyamide-imide silicone resin at a ratio of higher than 1:5 leads to deterioration in heat resistance of the back layer formed and generation of head buildup, while use thereof at a ratio of less than 5:1 leads to insufficient smoothness of the back layer formed and easier sticking to the thermal head.

Favorable polyamide-imide resins and polyamide-imide silicone resins are the same as those described in Japanese Patent Application Laid-Open No. 8-244369, and among them, those having a Tg of 200° C. or higher, as determined by differential thermal analysis, are used favorably. A polyamide-imide or polyamide-imide silicone resin having a Tg of lower than 200° C. is less heat resistant. The upper limit of Tg is not particularly limited from the viewpoint of heat resistance, but is approximately 300° C. from the viewpoint of solubility in common solvents.

The polyamide-imide silicone resin for use in the present invention is prepared by using a polyfunctional silicone compound having a molecular weight of 1,000 to 6,000 and copolymerizing it with polyamide-imide or by silicon-modifying polyamide-imide. The polyfunctional silicone compound for use is preferably a silicone compound having hydroxyl, carboxyl, epoxy, amino or acid anhydride groups. The content of silicone is preferably 0.01 to 0.3 with respect to the polyamide-imide resin by mass. An excessively smaller copolymerization or modification rate of silicone makes it difficult to prepare a back layer having a sufficiently high smoothness in the mixing range above, leading to easier sticking to the thermal head. An excessively larger copolymerization or modification rate of silicone leads to deterioration in heat resistance and film strength of the back layer formed.

The polyamide-imide and polyamide-imide silicone resins for use in the present invention are preferably soluble in alcoholic solvents, from the general viewpoint of safety in working environments during production.

The back layer according to the invention contains a polyvalent metal salt of alkyl phosphoric ester and a metal salt of alkylcarboxylic acid. The polyvalent metal salt of alkyl phosphoric ester is prepared by substituting an alkali-metal salt of alkylphosphoric acid ester with a polyvalent metal. These salts are known as plastic additives, and those in various grades are available.

Favorable examples of the polyvalent metal salts of alkylphosphoric ester are represented by the following formula 1:

[Formula 1]

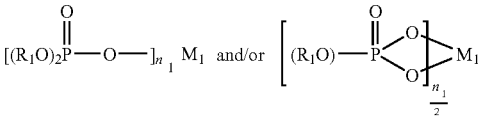

In the Formula above, $R_1$ represents an alkyl group having 12 or more carbon atoms, preferably a C12 to C18 alkyl group such as cetyl, lauryl, or stearyl, and particularly preferably a stearyl group, from the viewpoint of sliding property during printing. $M_1$ represents an alkali-earth metal, preferably barium, calcium and magnesium, zinc or aluminum; $n_1$ represents the valency of the metal $M_1$.

The polyvalent metal salt of alkylphosphoric ester used has an average particle size of 5 to 20 μm, preferably 5 to 15 μm. An excessively greater average particle size leads to easier staining by buildup on the head and printed-image staining during printing, while an excessively smaller average particle size causes a problem of insufficient smoothness during printing. In addition, an excessively greater average particle size leads to exposure of the binder in the area between particles and sticking of binder on the thermal head, and consequently to increase in the amount of edge buildup.

Favorable examples of the metal salts of alkylcarboxylic acid are represented by the following formula 2:

[Formula 2]

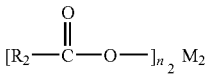

In the Formula above, $R_2$ represents an alkyl group having 11 or more carbon atoms, preferably a C11 to C18 alkyl group such as dodecyl, hexadecyl, heptadecyl, or octadecyl, more preferably a dodecyl, heptadecyl, or octadecyl group, and particularly preferably an octadecyl group (stearyl group), from the viewpoint of sliding property during printing. $M_2$ represents an alkali-earth metal, preferably barium, calcium and magnesium, zinc, aluminum or lithium, and $n_2$ represents the valency of the metal $M_2$.

Salts having a smaller number of $R_2$ carbons are undesirable, because they are rather difficult to purchase commercially and higher in cost, and additionally, lead to decline of the molecular weight of the entire composition, causing exudation of the lubricant out of the back layer and staining on the other regions. The metal $M_2$ is selected properly according to the temperature condition used during thermal transfer. For reference, the melting points of barium salts are 190° C. or higher; calcium salts, approximately 140 to 180° C.; magnesium salts, approximately 110 to 140° C.; zinc salts, approximately 110 to 140° C.; aluminum salts, approximately 110 to 170° C.; and lithium salts, 200° C. or higher. Magnesium, zinc, and aluminum salts are preferable, and in particular, zinc salts are particularly preferable in the present invention.

A metal salt of alkylcarboxylic acid used has an average particle size of 5 to 20 μm, preferably 5 to 15 μm. An excessively greater average particle size leads to increase in the amount of buildup formed during printing and generation of printed-image staining, while an excessively smaller particle size causes problems such as in sufficient smoothness and increase in friction during printing, and consequently, printed-image wrinkling and others.

The mass ratio of the polyvalent metal salt (C) of alkylphosphoric ester to the metal salt (D) of alkylcarboxylic acid used, C:D is 1:9~9:1, preferably 2:8~8:2. An excessively larger amount of the metal salt of alkylcarboxylic acid used leads to easier deposition of buildup on the thermal head, while an excessively lower amount to disappearance of addition effects.

The mixture of a polyvalent metal salt (C) of alkylphosphoric ester and a metal salt (D) of alkylcarboxylic acid is preferably used in an amount of 1 to 100 parts by mass, preferably 5 to 30 parts by mass, with respect to 100 parts by mass of the binder. An excessively smaller amount of the mixture leads to deterioration in release property of thermal head during heat application and to easier deposition of buildup on the thermal head. On the other hand, an excessively larger amount is undesirable, because it leads to deterioration in physical strength of the back layer.

The silicone oil contained in the back layer functions as a lubricant, and is preferably a modified silicone oil, an unmodified silicone oil, or a mixture thereof, having a viscosity 10 to 1,100 $mm^2$/sec, preferably 30 to 1000 $mm^2$/sec. When a high-viscosity silicone oil is used, it is lower in compatibility with the binder resin, sufficient release property can not be achieved and effects in preventing printed-image staining can not be achieved. On the contrary, use of a low-viscosity silicone oil raises a problem of transfer of the silicone oil onto the opposite face when a thermal transfer sheet is rolled up.

The modified silicone oil favorably used is an epoxy-, carbinol-, phenol-, methacrylic- or polyether-modified silicone oil, and the unmodified silicone oil is preferably a dimethylsilicone oil, a methylphenylsilicone oil, or a mixture thereof. A mixture of two or more silicone oils is effective in increasing release property and preventing printed-image staining more efficiently. In particular, use of a mixture of silicone oils different in viscosity is more effective in improving the release property. For example, use of a combination of a silicone oil having a viscosity of less than 100 $mm^2$/sec and another silicone oil having a viscosity of 100 $mm^2$/sec or more in the viscosity range above is preferable. If two or more silicone oils are mixed, combination of a modified silicone oil and an unmodified silicone oil is preferable, and it is effective in improving heat resistance, wrinkle-resistance, release property, and others.

The silicone oil is contained in an amount of 1 to 30 parts by mass, preferably 1 to 10 parts by mass, with respect to 100 parts by mass of the binder. An excessively larger amount causes problems such as transfer of the silicone oil onto the opposite face when the sheet is wound and staining of the thermal head during printing, while an excessively smaller prohibits favorable release property and is less effective in preventing printed-image staining.

The inorganic filler (F) contained in the back layer is fine particles (F1) of an inorganic material having a Mohs' hardness of 3 or lessor a mixture of two kinds of fine particles (F1), fine particles (f2) of an inorganic material having a Mohs' hardness of more than 3. The inorganic filler functions to clean deposits on the head; the fine particles having a smaller Mohs' hardness in particular are responsible for performing cleaning while suppressing the frictional force to a suitable degree, while the fine particles having a larger Mohs' hardness is responsible in particular for removing deposits that are not cleaned by the fine particles F1.

The Mohs' hardness is determined by using a Mohs' hardness meter. The Mohs' hardness meter, which was invented by F. Mohs, uses ten kinds of soft to hard minerals stored in a box, each having a hardness of 1 to 10 degree. The standard minerals used are the followings (number indicates hardness): 1: talc, 2: gypsum, 3: calcite, 4: fluorite, 5: apatite, 6: orthoclase, 7: quartz, 8: topaz, 9: corundum and 10: diamond.

The hardness of a mineral can be determined by comparing the resistances to scratching (presence of scratches) when the surface thereof is rubbed with each of the standard minerals. For example, a mineral that is scratched with calcite has a hardness of more than 3. A mineral scratched with fluorite but not with fluorite has a hardness of smaller than 4. The hardness of the sample is expressed as 3 to 4 or 3.5. When the sample and the standard mineral are both scratched, the sample has the same hardness as that of the standard mineral. The hardness determined by using a Mohs' hardness meter is a rank order and not an absolute value.

The raw materials for fine particles of inorganic fillers (F1) and (F2) may be the same as each other. For example, talc may be used for both fine particles (F1) and (F2). With talc, it is possible to adjust the Mohs' hardness by selecting the kinds and the ratio of the constituent components properly. Similarly to the talc above, other inorganic filler can be formed as an inorganic material having a various Mohs' hardness. The filler according to the present invention may be prepared and used by pulverizing and classifying such an inorganic material.

The inorganic filler itself used in the present invention is known and selected from various compounds, and examples thereof include talc, kaolin, mica, graphite, niter, gypsum, brucite, graphite, calcium carbonate, molybdenum disulfide, and the like, and talc, mica and calcium carbonate are particularly preferable from the viewpoint of the balance between heat resistance and smoothness.

The inorganic filler fine particles (F1) and (F2) are preferably used as mixed at a ratio F1:F2 of 10:0 to 3:7, preferably 10:0 to 5:5, more preferably 10:0 to 6:4 by mass. A greater addition amount of the fine particles (F2) leads to increase in the efficiency of scraping the surface buildup adhering on the thermal head, but an excessively greater amount leads to increase in the abrasive wear of the thermal head.

The average particle size of the filler is also important, and the average particle sizes of inorganic filler fine particles (F1) and (F2) may vary according to the thickness of the back layer formed, but are respectively, in the range of 0.05 to 5.5 μm, preferably 0.05 to 5.1 μm. An average particle size of more than 5.5 μm is not desirable, because abrasion of the thermal head becomes faster and also results in distinct increase of the scratches on the printed-image face when the filler is separated from the back layer. On the other hand, an average particle size of less than 0.05 μm is also undesirable, because cleaning property is low when the buildup is deposited on the thermal head.

The amount of the filler added is in the range of 2 to 20 parts by mass, preferably 5 to 15 parts by mass, with respect to 100 parts by mass of the binder, for improvement in smoothness and heat resistance. An addition amount of less than the range above is ineffective in improving heat resistance and causes fusing on the thermal head, while an addition amount of more than the range above leads to deterioration in flexibility and strength of the back layer.

The back layer is formed by forming a coating solution by dissolving or dispersing the materials described above in a binder solvent such as toluene/ethanol (1/1) and applying and drying the coating solution by a common coating method such as gravure coating, roll coating, or wire bar coating. The amount of the back layer coated is 0.7 g/m$^2$ or less, preferably 0.1 to 0.6 g/m$^2$, more preferably 0.3 to 0.6 g/m$^2$ as dry solid matter, for forming a back layer having favorable properties. An excessive thinner back layer leads to insufficient expression of the functions of the back layer. On the other hand, an excessively thicker back layer is also unfavorable, because it leads to deterioration in sensitivity during printing.

In the invention, the average particle size of various particles is a value determined by a laser diffraction/scattering method.

(Transfer Ink Layer)

The transfer ink layer formed on the other face of the substrate film is a sublimable dye-containing layer, i.e., a thermally sublimable dye layer in the case of a sublimable thermal-transfer sheet, and a thermomelting ink layer colored, for example, with a pigment, in the case of a heat-fusing transfer sheet. Hereinafter, a sublimable thermal-transfer sheet will be described as a typical example, but the present invention is not limited only to the sublimable thermal-transfer sheet.

The dye used in the sublimable transfer ink layer is not particularly limited, and any dye used in known thermal-transfer sheets may be used. Some favorable examples of the dyes include red dyes such as MS Red G, Macro Red Vioret R, Ceres Red 7B, Samaron Red HBSL, and Resolin Red F3BS; yellow dyes such as Holon Brilliant Yellow 6GL, PTY-52, and Macrolex Yellow 6G; blue dyes such as Kayaset Blue 714, Waxoline Blue AP-FW, Holon Brilliant Blue S-R, MS Blue 100, and the like.

Favorable example of the binder resin for supporting such a dye include cellulosic resins such as ethylcellulose, hydroxyethylcellulose, ethylhydroxycellulose, hydroxypropylcellulose methylcellulose, cellulose acetate, and cellulose tributyrate; vinyl resins such as polyvinylalcohol, polyvinyl acetate, polyvinylbutyral, polyvinyl acetoacetal, and polyvinylpyrrolidone; acrylic resins such as poly(meth)acrylate and poly(meta)acrylamide; polyurethane resins, polyamide resins, polyester resins, and the like. Among them, cellulosic, vinyl, acrylic, urethane and polyester resins are preferable from the view point of heat resistance and dye-transfer efficiency.

The dye layer may be formed by dissolving a dye, a binder, and as needed additives such as releasing agent and inorganic fine particles in a suitable organic solvent such as toluene, methylethylketone, ethanol, isopropyl alcohol, cyclohexanone, or DME or dispersing them in an organic solvent or water, and applying and drying the solution or dispersion on one face of a substrate film, for example, by means of a gravure printing, screen printing, or reverse-roll coating by using a gravure plate.

The amount of the dye layer thus formed is approximately 0.2 to 5.0 g/m$^2$, preferably 0.4 to 2.0 g/m$^2$, as dry solid matter, and the amount of the sublimable dye in the dye layer is 5 to 90% by mass, preferably 10 to 70% by mass, with respect to the mass of the dye layer. The dye layer is formed with a dye in one color if the desired image is monochromic, and a layer containing dyes in yellow, magenta and cyan (further as needed blank) is formed with suitable dyes, for example, in cyan, magenta and yellow (further as needed black) properly selected, if the desired image is in full color.

The image-receiving sheet or an image-receiving medium on which an image is formed with a thermal-transfer sheet, is not particularly limited, if the recording surface thereof accepts the dye, and, if the substrate is paper, metal, glass, or a synthetic resin that hardly accepts dye, a dye-receiving layer is formed on at least one surface thereof. If a heat-fusing transfer sheet is used, the image-receiving medium is not particularly limited and may be normal paper or a plastic film. The printer for use during thermal transfer by using a thermal-transfer sheet and an image-receiving sheet is not particularly limited, and any one of known thermal transfer printers may be used as it is.

Hereinafter, the present invention will be described with reference to Examples, and the "parts" and "%" therein mean respectively "parts by mass" and "% by mass", unless otherwise specified.

The polyamide-imide resin (HR-15ET, Toyobo Co., Ltd.) used in the following Examples has Tg of 260° C., and the polyamide-imide silicone resin (HR-14ET, Toyobo Co., Ltd.) has Tg of 250° C.

EXAMPLE 1

The following materials were respectively dispersed in a mixed solvent of ethanol/toluene (1/1 by mass) to a solid content of 10%, and the mixture was stirred and dispersed in a paint shaker for 3 hours, to give a back layer ink. The ink was applied on one face of a polyester film (Lumirror, 4.5 μm, manufactured by Toray Industries, Inc.) by using a wire bar coater to a coating amount of 0.5 g/m$^2$ after drying and dried in an oven at 80° C. for 1 minute, to form a back layer.

| (Back layer materials) | |
|---|---|
| Polyamide-imide resin (HR-15ET, Toyobo Co., Ltd.) | 50 parts |
| Polyamide-imide silicone resin (HR-14ET, Toyobo Co., Ltd.) | 50 parts |
| Silicone oil (X-22-173DX, Shin-Etsu Chemical Co. , Ltd.) | 2.5 parts |
| Silicone oil (KF965-100, Shin-Etsu Chemical Co., Ltd.) | 2.5 parts |
| Zinc stearyl phosphate (LBT-1830 purified, Sakai Chemical Industry Co., Ltd.) (average particle size: 10 μm) | 10 parts |
| Zinc stearate (SZ-PF, Sakai Chemical Industry Co., Ltd.) (average particle size: 10 μm) | 10 parts |
| Polyester resin (Vylon 220, Toyobo Co., Ltd.) | 3 parts |
| Inorganic filler (F1) (talc, average particle size: 5.1 μm, Mohs' hardness: 3) | 10 parts |

A dye layer was formed as a transfer ink layer on the other face of the substrate film, to give a thermal-transfer sheet according to the present invention of Example 1. The dye layer was prepared, in a similar manner to the dye layer on a thermal-transfer sheet for a sublimation printer CP8000 manufactured by Mitsubishi Electric Corporation. The image-receiving sheet used in the following evaluations was an image-receiving sheet (standard type) for the sublimation printer CP8000 manufactured by Mitsubishi Electric Corporation.

EXAMPLES 2 TO 7

Thermal-transfer sheets were prepared in a similar manner to Example 1, except that a part of the inorganic filler (F1) used in Example 1 was replaced with an inorganic filler (F2) (talc, average particle size 4.9 μm, Mohs' hardness 7) at the ratio shown in the following Table 1.

TABLE 1

| Example | Inorganic filler (F1) Mohs' hardness: 3 | Inorganic filler (F2) Mohs' hardness: 7 |
|---|---|---|
| Example 1 | 10 parts | 0 parts |
| Example 2 | 9 parts | 1 parts |
| Example 3 | 8 parts | 2 parts |
| Example 4 | 7 parts | 3 parts |
| Example 5 | 6 parts | 4 parts |
| Example 6 | 5 parts | 5 parts |
| Example 7 | 3 parts | 7 parts |

COMPARATIVE EXAMPLE 1

A thermal-transfer sheet of Comparative Example 1 was prepared in a similar manner to Example 1, except that the average particle size of zinc stearate in the thermal-transfer sheet prepared in Example 1 was changed to 25 μm.

| (Back layer materials) | |
|---|---|
| Polyamide-imide resin (HR-15ET, Toyobo Co., Ltd.) | 50 parts |
| Polyamide-imide silicone resin (HR-14ET, Toyobo Co., Ltd.) | 50 parts |
| Silicone oil (X-22-173DX, Shin-Etsu Chemical Co., Ltd.) | 2.5 parts |
| Silicone oil (KF965-100, Shin-Etsu Chemical Co., Ltd.) | 2.5 parts |
| Zinc stearyl phosphate (LBT-1830 purified, Sakai Chemical Industry Co., Ltd.) (average particle size: 10 μm) | 10 parts |
| Zinc stearate (GF-200, NOF Corporation) (average particle size: 25 μm) | 10 parts |
| Polyester resin (Vylon 220, Toyobo Co., Ltd.) | 3 parts |
| Inorganic filler (F1) (talc, average particle size: 5.1 μm, Mohs' hardness; 3) | 10 parts |

COMPARATIVE EXAMPLE 2

A thermal-transfer sheet of Comparative Example 3 was prepared in a similar manner to Example 1, except that the inorganic filler in the thermal-transfer sheet prepared in Example 1 was changed to an inorganic filler (F2).

| (Back layer materials) | |
|---|---|
| Polyamide-imide resin (HR-15ET, Toyobo Co., Ltd.) | 50 parts |
| Polyamide-imide silicone resin (HR-14ET, Toyobo Co., Ltd.) | 50 parts |
| Silicone oil (X-22-173DX, Shin-Etsu Chemical Co., Ltd.) | 2.5 parts |
| Silicone oil (KF965-100, Shin-Etsu Chemical Co., Ltd.) | 2.5 parts |
| Zinc stearyl phosphate (LBT-1830 purified, Sakai Chemical Industry Co., Ltd.) (average particle size: 10 μm), | 10 parts |
| Zinc stearate (SZ-PF, Sakai Chemical Industry Co., Ltd.) (average particle size: 10 μm) | 10 parts |
| Polyester resin (Vylon 220, Toyobo Co., Ltd.) | 3 parts |
| Inorganic filler (F2) (talc, average particle size: 4.9 μm, Mohs' hardness: 7) | 10 parts |

(Evaluation)

The thermal-head abrasion, buildup-adherability to thermal-head, printed-image staining, and printed-image wrinkling of the thermal-transfer sheets obtained in Examples and Comparative Examples above were evaluated. Results are summarized in the following Table 2.

TABLE 2

| Example | Thermal-head abrasion | Buildup-adherability to thermal-head | Printed-image staining | Printed-image wrinkling | Edge buildup |
|---|---|---|---|---|---|
| Example 1 | ○ | ○ | ○ | ○ | ○ |
| Example 2 | ○ | ○ | ○ | ○ | ○ |
| Example 3 | ○ | ○ | ○ | ○ | ○ |
| Example 4 | ○ | ○ | ○ | ○ | ○ |
| Example 5 | ○ | ○ | ○ | ○ | ○ |
| Example 6 | Δ | ○ | ○ | Δ | Δ |
| Example 7 | Δ | ○ | ○ | Δ | Δ |
| Comparative Example 1 | ○ | ○ | Δ | ○ | x |
| Comparative Example 2 | x | ○ | ○ | Δ | ○ |

(Thermal-Head Abrasion)

A solid image was printed continuously over a distance of 10 km in a sublimation printer (trade name: CP8000, manufactured by Mitsubishi Electric Corporation.), and the abrasion wear of the thermal-head protection film was determined.

(Evaluation Criteria)
○: Less than 1 μm
Δ: 1 to 3 μm
×: More than 3 μm (Buildup-Adherability to Thermal-Head)

A 50 area % hatched pattern was printed over a distance of 100 m by using a thermal head (KST-105-13FAN21-MB (Kyocera Corporation)) under the condition of 4 kgf load and printing energy of 0.44 mJ/dot, and the amount of the deposit formed on the thermal-head heating unit was observed under a microscope.

(Evaluation Criteria)
○: Less than 3,000 Å
Δ: 3,000 to 5,000 Å
×: More than 5,000 Å

(Printed-Image Staining)

A solid pattern and a half tone pattern were printed continuously, by using a sublimation printer (trade name: CP8000, manufactured by Mitsubishi Electric Corporation.), and presence of printed-image staining by tailing was evaluated by visual observation.

(Evaluation Criteria)
○: No printed-image staining by tailing
×: Some printed-image staining by tailing, being defective printed image (Printed-Image Wrinkling)

A solid image was printed by using a sublimation printer (trade name CP8000, manufactured by Mitsubishi Electric Corporation Co., Ltd.), and the number of winkles generated in the printed image was determined by visual observation.

(Evaluation Criteria)
○: None
Δ: 1 to 3
×: More than 3

(Edge Buildup)

A solid image of 127 mm in width was printed continuously over a distance of 200 m on image-receiving paper by using a sublimation printer (trade name: CP8000, manufactured by Mitsubishi Electric Corporation.) and then, a half tone image of 152 mm in width was printed continuously on the image-receiving paper, and the number of printed sheet with white line was determined by visual observation.
○: No white line
Δ: 1 to 2
×: 3 or more The invention claimed:

1. A thermal-transfer sheet having a substrate film, a transfer ink layer formed on one face thereof, and a back layer formed on the other face thereof, the back layer comprising:

a binder containing a polyamide-imide resin (A) having a Tg of 200° C. or higher and a polyamide-imide silicone resin (B) having a Tg of 200° C. or higher, as determined by differential thermal analysis, a mixture of a polyvalent metal salt (C) of alkylphosphoric ester and a metal salt (D) of alkylcarboxylic acid, a silicone oil (E) in an amount of 1 to 30 parts with respect to 100 parts by mass of the binder, and an inorganic filler (F) containing fine particles (F1) of an inorganic material having a Mohs' hardness of 3 or less alone or a mixture of fine particles (F1) of an inorganic material and fine particles (F2) of an inorganic material having a Mohs' hardness of more than 3, the metal salts (C) and (D) having an average particle size of 5 μm to 20 μm and the inorganic filler (F) having an average particle size of 0.05 to 5.5 μm.

2. The thermal-transfer sheet according to claim 1, wherein the blending ratio of the polyamide-imide resin (A) and the polyamide-imide silicone resin (B) is A:B=1:5 to 5:1 by mass.

3. The thermal-transfer sheet according to claim 1 or 2, wherein the blending ratio of the polyvalent metal salt (C) of alkylphosphoric ester and the metal salt (D) of alkylcarboxylic acid is C:D=1:9 to 9:1 by mass.

4. The thermal-transfer sheet according to claim 1, wherein the fine particles (F1) are talc, mica, calcium carbonate, or a mixture thereof.

5. The thermal-transfer sheet according to claim 1, wherein the fine particles (F2) are talc, mica, calcium carbonate or a mixture thereof.

6. The thermal-transfer sheet according to claim 1, wherein a content of the inorganic filler is 2 to 20 parts by mass with respect to 100 parts by mass of the binder.

7. The thermal-transfer sheet according to claim 1, wherein a thickness of the back layer is 0.30 to 0.60 g/m$^2$.

* * * * *